US011547193B2

(12) United States Patent
Chiastra et al.

(10) Patent No.: US 11,547,193 B2
(45) Date of Patent: Jan. 10, 2023

(54) DIFFUSER DEVICE FOR COSMETIC LIQUIDS FOR HAIR DRYERS

(71) Applicant: ELCHIM S.P.A., Milan (IT)

(72) Inventors: Paolo Chiastra, Milan (IT); Roberto Sabbatini, Milan (IT)

(73) Assignee: ELCHIM S.P.A., Milan (IT)

( * ) Notice: Subject to any disclaimer, the term of this patent is extended or adjusted under 35 U.S.C. 154(b) by 254 days.

(21) Appl. No.: 16/898,241

(22) Filed: Jun. 10, 2020

(65) Prior Publication Data

US 2020/0390217 A1 Dec. 17, 2020

(30) Foreign Application Priority Data

Jun. 11, 2019 (IT) ..... 102019000008601

(51) Int. Cl.
*A45D 20/12* (2006.01)
*A45D 20/50* (2006.01)
*A61Q 5/12* (2006.01)

(52) U.S. Cl.
CPC ..... *A45D 20/122* (2013.01); *A61Q 5/12* (2013.01)

(58) Field of Classification Search
CPC ..... A45D 20/12; A45D 20/122; A45D 20/50; A45D 24/00; A45D 24/22; F26B 21/00; F26B 21/06; F26B 21/10; F26B 21/12
See application file for complete search history.

(56) References Cited

U.S. PATENT DOCUMENTS 5,572,800 A 11/1996 West
5,987,771 A * 11/1999 Curtin ..... A45D 34/00 34/97
8,720,078 B1 * 5/2014 Behbehani ..... A45D 20/10 34/97
2003/0159306 A1 8/2003 Yeung
2005/0198854 A1 * 9/2005 Hobe ..... A45D 20/12 34/96

(Continued)

FOREIGN PATENT DOCUMENTS

EP 1685775 A1 8/2006
FR 2976776 A1 12/2012
GB 2308062 A 6/1997

(Continued)

OTHER PUBLICATIONS

Machine Translation of the abstract of FR 2976776A1 dated Dec. 28, 2012.

(Continued)

*Primary Examiner* — Gregory A Wilson

(74) *Attorney, Agent, or Firm* — Hedman & Costigan, P.C.; James V. Costigan; Kathleen A. Costigan

(57) ABSTRACT

Diffuser device for cosmetic liquids for hair dryers, characterized in that it comprises a cylindrical barrel, which can be associated with the blowing part of a hair dryer; said cylindrical barrel housing a diaphragm comprising a transverse septum which has a central expansion and lateral lobes; said lateral lobes defining respective lateral passages; said lateral passages and said transverse septum causing the air produced by said blowing part to pass in the form of two flows channeled to the exit of said device with laminar motion. The device makes passage of the air that passes through it more uniform in pressure and temperature, and at the same time enables cosmetic products to be dispensed for hair treatment.

6 Claims, 3 Drawing Sheets

(56) References Cited

U.S. PATENT DOCUMENTS

| | | | | |
|---|---|---|---|---|
| 2016/0302548 | A1* | 10/2016 | Yamazaki | A61H 23/0263 |
| 2018/0042356 | A1* | 2/2018 | Pavis | A45D 20/10 |
| 2018/0064227 | A1* | 3/2018 | Matheny | A45D 20/122 |

FOREIGN PATENT DOCUMENTS

| | | | | |
|---|---|---|---|---|
| JP | 2006204596 | A | | 8/2006 |
| WO | 2008015704 | A1 | | 2/2008 |
| WO | 2011-113193 | | * | 9/2011 |

OTHER PUBLICATIONS

Machine Translation of the abstract of JP 2006204596A published Aug. 10, 2006 which issued from Japanese Patent Application No. JP2005021418A filed Jan. 28, 2005.
European Search Report from priority application IT 201900008601 dated Jan. 31, 2020.

* cited by examiner

DIFFUSER DEVICE FOR COSMETIC LIQUIDS FOR HAIR DRYERS

BACKGROUND OF THE INVENTION

The present invention relates to a diffuser device for cosmetic liquids for hair dryers.

As is known, the professional hairdresser uses the hair dryer with devices that try to maximize the result on the hair, with an air flow that is uniform, both in aerodynamic and thermal terms.

It is known that hair dryers are associated with a device suitable for diffusing cosmetic liquids to further improve the result on the hairstyle.

Hair dryers intended for hairdressers generally have a concentrator nozzle, the shape of which, being thin at the end, makes it possible to alter the set of the hair by means of air and temperature.

This nozzle shape derives from decades of improvements, while the use of reservoirs or means for adding on cosmetic products is relatively recent.

WO2008015704A1 describes a device comprising a support material, soaked with a substance for hair. The device is provided as a concentrator accessory which is to be fitted to the outlet of a hair dryer.

U.S. Pat. No. 5,572,800 describes a fragrance dispenser which can be connected to the mouth of a hair dryer and comprises a replaceable fragrance emission element.

GB2308062 describes a hair dryer comprising a cylindrical support mounted inside its front tubular portion carrying a heating resistance, an air injection nozzle, a fan to inject air through the resistance support and the nozzle, and a support for a water container mounted in the tubular portion and communicating with the resistance support through a drip distribution outlet so as to humidify the flow of air passing through the resistance support and the nozzle.

EP1685775, which originates from Japanese patent application JP20050021418, describes a hair dryer with an atomizing device that generates a mist of electrostatically charged microparticles through a pair of atomizing electrodes. The system has a separate reservoir for storing water.

As early as 1960, in its catalogs this Applicant presented a hair dryer that emitted perfumes and balsamic essences through suction, by means of a felt intercepting the air introduced by the fan inside the hair dryer.

The liquid and cosmetic hair conditioner diffusion systems described above do not however offer adequate performance for reasons that will be described below, in relation to the fluid dynamics of hair dryers.

A real fluid with laminar motion in the x direction, whether in liquid or even gaseous phase, inside a circular duct, has a flow whose velocity "v" generally varies parabolically with a maximum in the center and a minimum at the circumference of the duct. This behavior is due to many physical and chemical factors, among which the viscosity and resistance provided by intimate contact with the walls (boundary layer) are prominent.

If the fluid encounters variations in cross-section with regular increases or decreases along its path, the behavior of the velocity is affected by some characteristic phenomena summarized by the Bernoulli equation, as far as macroscopic effects are concerned. In particular, if the piezometric heads between inlet and outlet are fixed, pressure and velocity are linked in an inversely proportional way. That is, for a reduction in cross-section, for the same flow rate and piezometric head there is thus an increase in velocity and a drop in pressure, and vice versa.

If the barrel is constricted along its length with the cross-section changing from circular to rectangular with rounded edges in a non-abrupt way, this particular geometry gives rise to a further physical phenomenon, which is much less known but still characterizing, which results in double vorticity, with the vortices located at the ends and rotating in two opposite directions.

This phenomenon takes its name from the physicists Dean and Nekrassov who first identified and studied it. In practice, Dean vortices (or Nekrassov vortices) are formed when in addition to being subject to the parabolic trend, the fluid threads are forced to increase in velocity due to the decrease in cross-section, which moreover changes from circular to flattened elliptical. The forced change in direction causes changes in velocity and therefore in acceleration.

In particular, two lateral vortices are formed while the central portion remains in laminar motion.

In the case of a hair dryer, the typically circular outlet barrel is normally throttled by a concentrator designed to allow styling and drying operations, which would otherwise not be possible.

The outlet, typically with a flattened elliptical cross-section or with a rectangular cross-section, specifically enables the air flow to be concentrated, with a corresponding increase in velocity and also in heat.

It is these two factors, and in particular the temperature that must be uniform, that enables the hairdresser to give the desired set to a hairstyle.

Precisely because of the particular shape of the conduit comprising the barrel of the hair dryer and the concentrator inserted upon it, the aforementioned two vortices are formed and, in addition to preventing a uniform outflow of hot air, distribute the heat mainly around the vortices, so there are areas with different temperatures in the air flow.

The hairdresser's work is therefore more difficult and time-consuming because he/she has to go over a lock several times in order to obtain greater uniformity.

The result can be seen directly on the hair, where shine of the hair is not uniform when the various areas have been treated at different temperatures.

SUMMARY OF THE INVENTION

The aim of the present invention is to provide a diffuser device for cosmetic liquids for hair dryers which overcomes the problems in the prior art described above.

Within the scope of this aim, an object of the invention is to provide a diffuser device for cosmetic liquids for hair dryers which ensures an optimal flow of air, producing better contact with the cosmetic liquids, which are not intercepted by the electrical resistance but benefit in diffusion from both air pressure and temperature.

Another object of the invention is to provide a device which can be manufactured as a separate part, intermediate in position between the air outlet barrel of the hair dryer and the terminal concentrating nozzle, for styling and other work on the hair.

Another object of the invention is to provide a device which can be incorporated directly into the hair dryer or into the concentrator accessory for styling, again maximizing its effectiveness.

A further object of the present invention is to provide a device which, due to its particular construction characteristics, is capable of ensuring the greatest reliability and safety in use.

These and other objects, which will be more apparent below, are accomplished through a diffuser device for cosmetic liquids for hair dryers, characterized in that it comprises a cylindrical barrel, which can be associated with the blowing part of a hair dryer; said cylindrical barrel housing a diaphragm comprising a transverse septum which has a central expansion and lateral lobes; said lateral lobes defining respective lateral passages; said lateral passages and said transverse septum providing a passage of the air produced by said blowing part in the form of two streams which are channeled to the outlet of said device with laminar motion.

BRIEF DESCRIPTION OF THE DRAWINGS

Further characteristics and advantages of the present invention will be more particularly apparent from an examination of the following detailed but not exclusive description of the preferred and not exclusive embodiments of the invention, illustrated by way of non-limitative example in the attached drawings, wherein.

DESCRIPTION OF THE PREFERRED EMBODIMENTS

Figure 1:
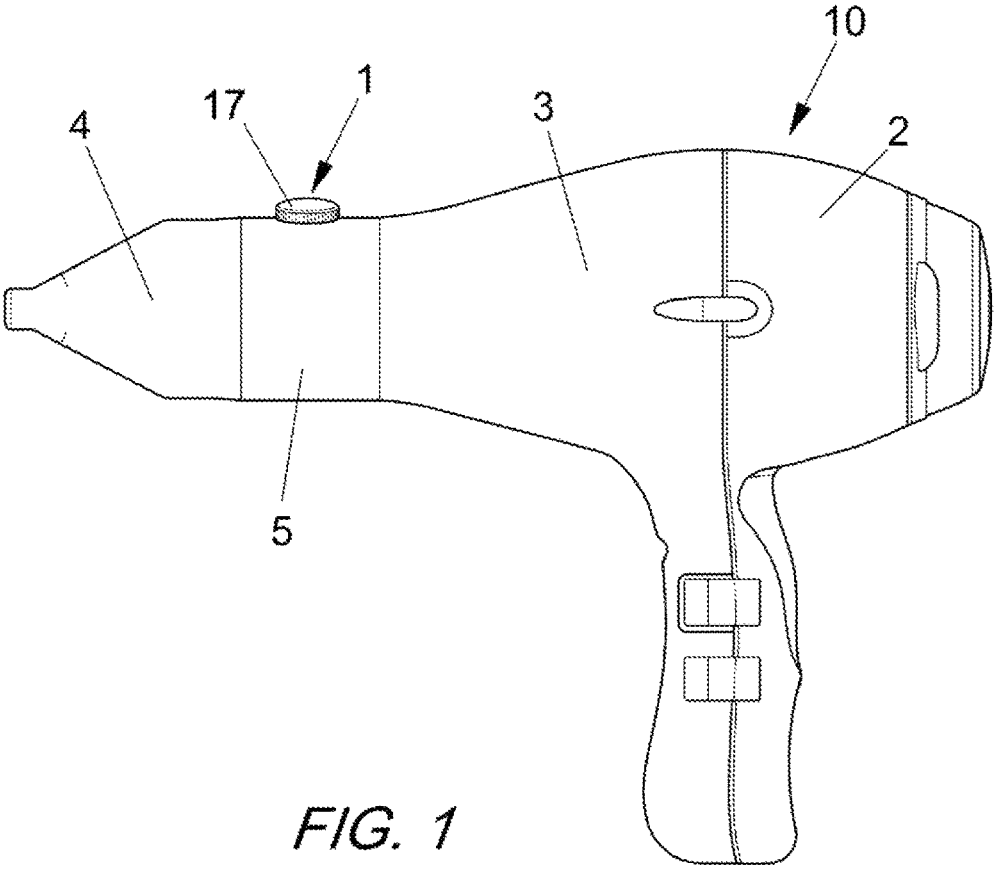
FIG. 1 is a side elevation view of a hair dryer fitted with the diffuser device according to the present invention.

With particular reference to the numerical symbols of the aforesaid figures, the diffuser device for cosmetic liquids for hair dryers, according to the invention, indicated as a whole with the reference number 1, is particularly intended for a hair dryer 10 comprising a suction part 2 and a blowing part 3 to which an outlet air concentrator 4 can be applied in a manner which is in itself known.

The device according to the invention comprises a cylindrical barrel 5, located at the outlet of the blowing part 3, which houses a diaphragm 6, in an intermediate position.

The diaphragm 6 comprises a transverse septum 7 having a central expansion 8 and lateral lobes 9 defining respective lateral passages 11.

The transverse septum 7 is a cylindrical body having a cavity 12 and provided with holes and slots 13 in the front part, i.e. facing the outlet mouth.

On the other hand, the rear part 14 of the transverse septum 7 has a smooth non-perforated profile.

The cavity 12 of the transverse septum 7 houses a pad 15 and is accessible via a hole 16 sealed by a hermetic plug 17.

The pad 15 is made of a natural (cotton) or artificial (non-woven fabric) textile material, which can be impregnated with cosmetic or perfuming liquids contained in sealed packages provided for the purpose.

The hermetic plug 17 can advantageously be fitted with a barbed stick 18 to facilitate removal of the pad 15 for replacement.

According to one embodiment of the present invention, the cylindrical barrel 5 has a female connection which enables the cylindrical barrel 5 to be attached to the blowing part 3 of the hair dryer as an appendage, and a male connection 19 to which an optional concentrator 4 may be connected.

According to this embodiment, the device 1 is of wide application, being able to operate with or without concentrators having different openings.

Figure 2:
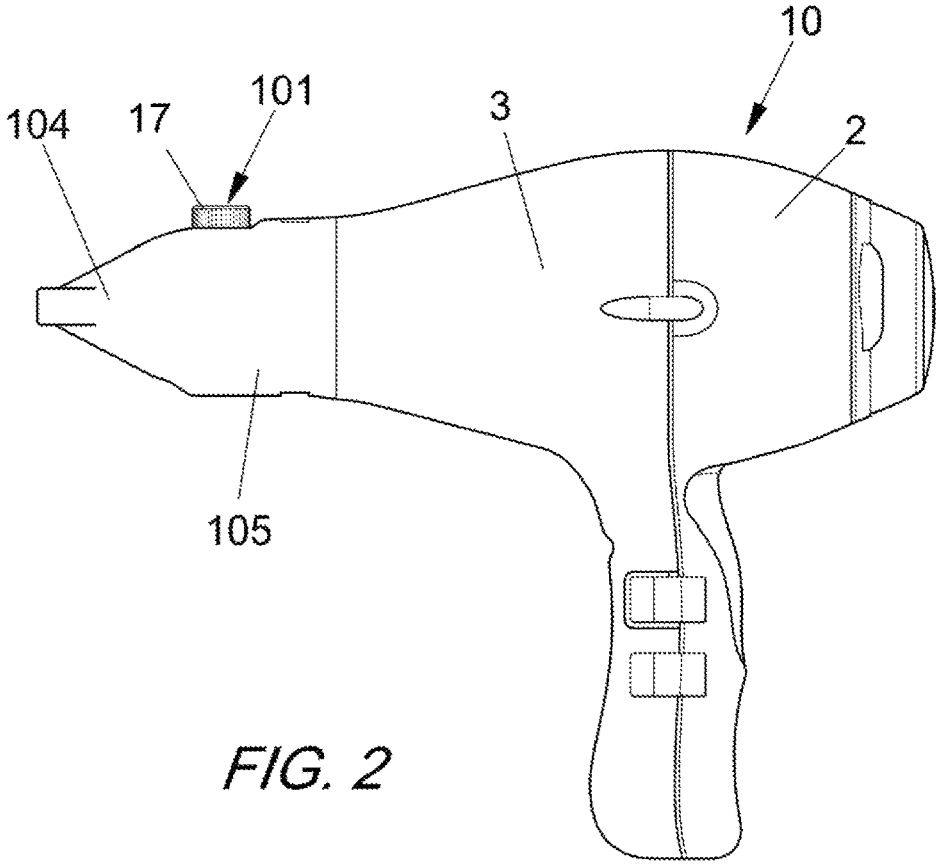
FIG. 2 is a side elevation view of a hair dryer fitted with the diffuser device according to a further aspect of the present invention.
Figure 3:
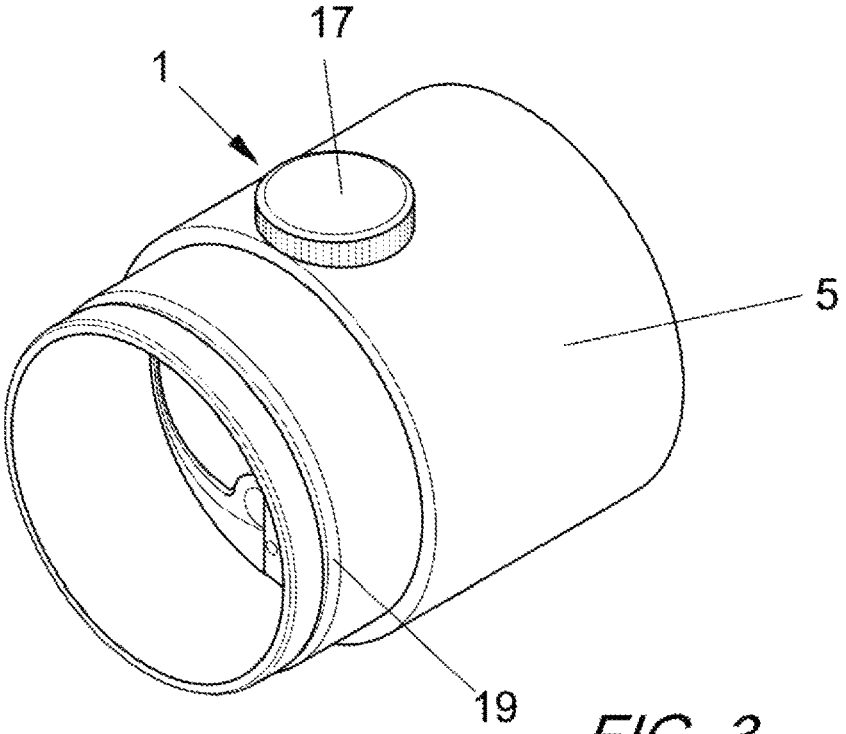
FIG. 3 is a perspective view of the device according to the present invention.
Figure 4:
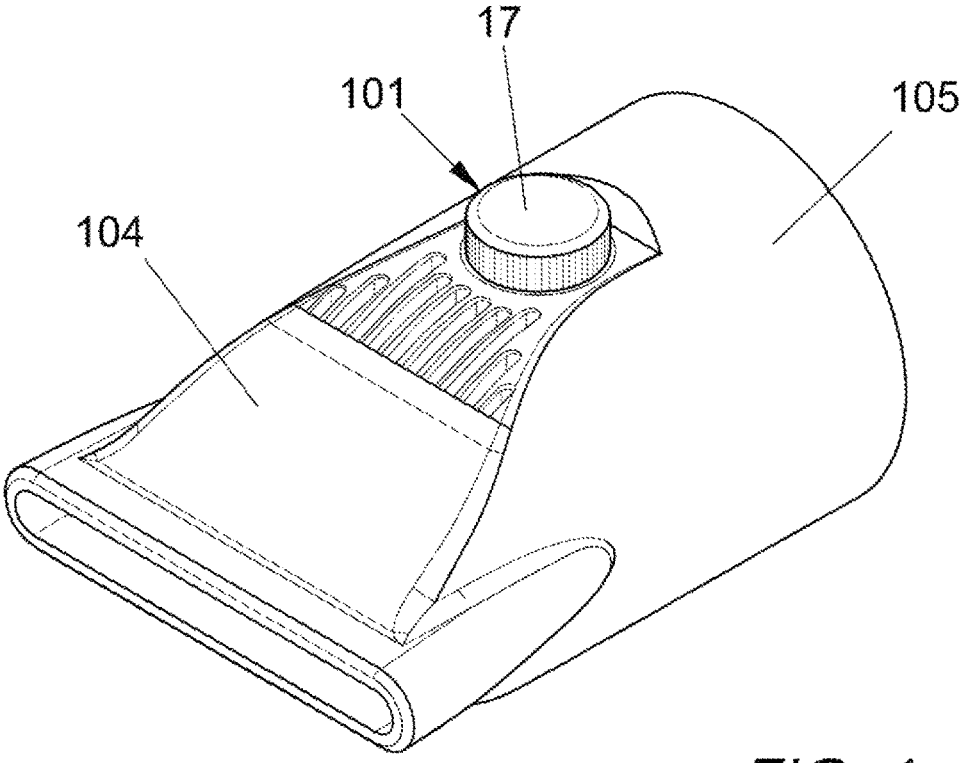
FIG. 4 is a perspective view of the device of the present invention according to the embodiment illustrated in FIG. 2.
Figure 5:
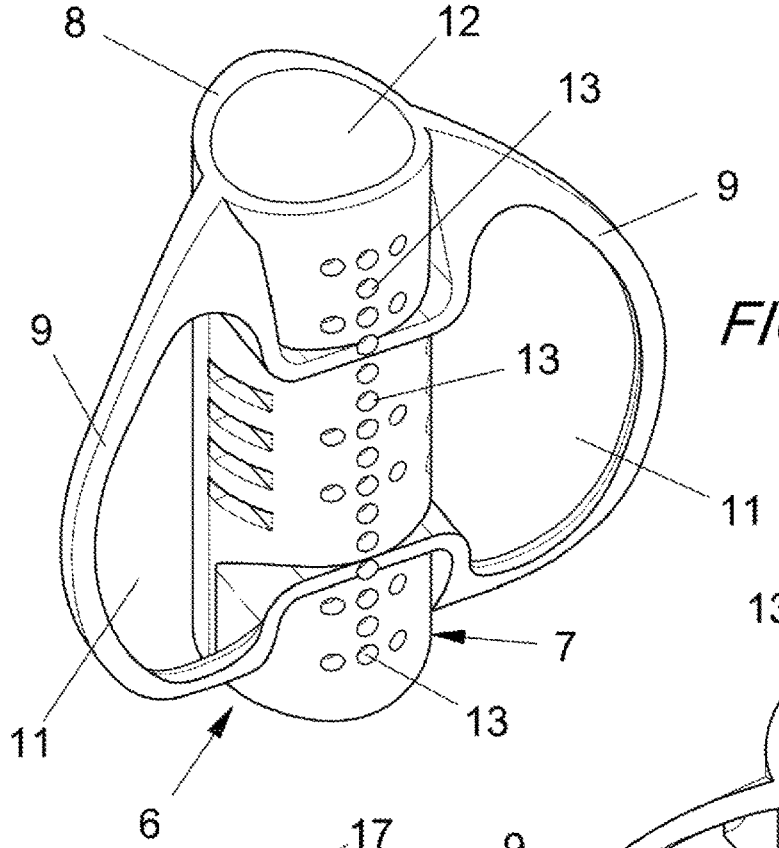
FIG. 5 is a front perspective view of the diaphragm.
Figure 6:
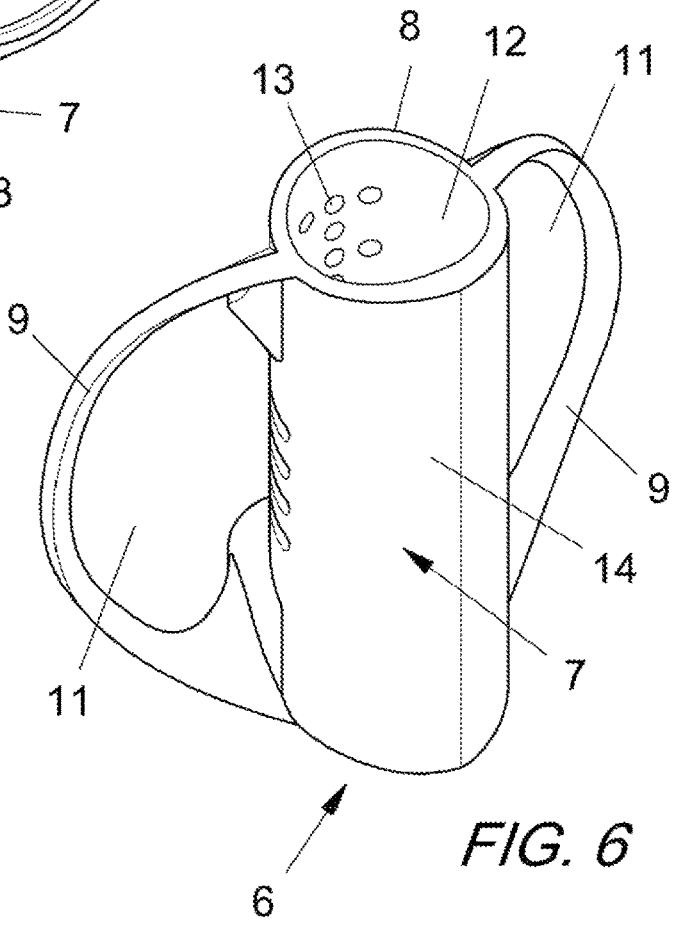
FIG. 6 is a rear perspective view of the diaphragm.
Figure 7:
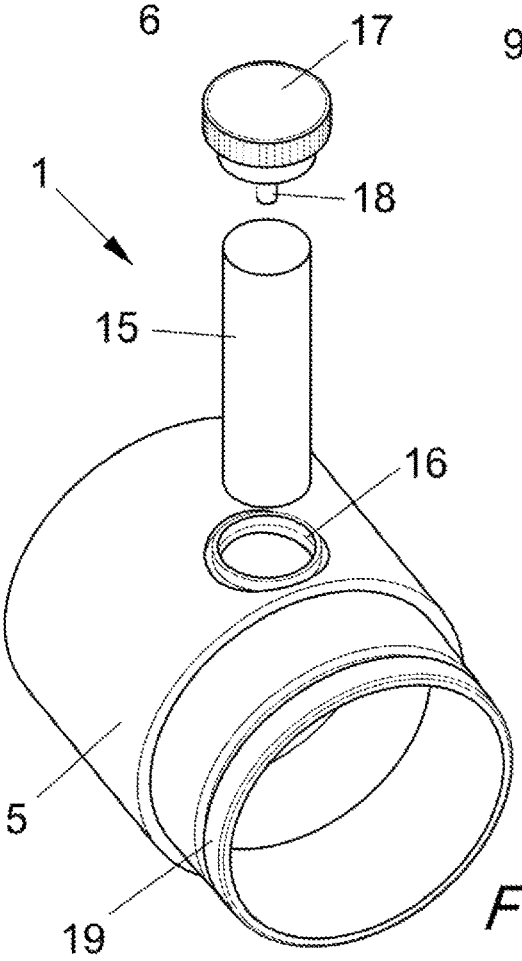
FIG. 7 is a partially exploded view of the device.

Alternatively, according to a further embodiment illustrated in FIGS. 2 and 4, the diffuser device, indicated by the reference number 101, is incorporated in a concentrator 104 forming a single body with the cylindrical barrel 105.

The cylindrical barrel 105 has a female connection through which the cylindrical barrel 105 can be attached to the blowing part 3 of the hair dryer 10.

According to the present invention, the particular shape of the diaphragm 6 makes it possible to eliminate the Dean vortices enabling the output flow to maintain the longitudinal velocity and, with it the heat transported, almost uniform.

In particular, the diaphragm 6, comprising the transverse septum 7 with expansion 8 in the center allows the air reaching it to divide on either side of it, passing along its surface.

Dean's vortices are eliminated through the central expansion 8, in this case of cylindrical shape, and the lateral passages 11, whose edges 9 are of suitable shape, limited by the circumference of the containing barrel 5 and which together with the latter define a gradual narrowing and favor aerodynamic adaptation to the subsequent concentrator section proper.

The air thus channeled, dividing, rejoins just downstream of the cylindrical cross-section, preventing Dean vortices from forming.

This is well evidenced by the visualizations obtained using a thermographic camera, where the uniform distribution of heat is immediately observable.

The cavity 12 of the transverse septum 7 houses the pad 15, soaked in cosmetic substance with possible alternative functional characteristics (smoothing, anti-frizz, perfuming, etc., etc.) which through the negative pressure of the air flow and the heat present can be diffused onto the hair being processed, through appropriate holes and slots 13 present in the front part, that is facing the air outlet mouth, from which it comes out.

In this case, in addition to the advantage of a faster and more uniform styling operation, hairdressers are able to cover the hair being treated with the emitted substance evenly, in a simple way and also in a lower dose than a conventional sprayer or spray, bringing further savings.

The cylindrical barrel 5 with female connection can be fitted to the blowing part 3 of the hair dryer 10 as an appendage, while the male connection 19 enables any concentrators of different width and shape to be connected.

In this case the device is widely applicable, being able to operate with or without concentrators having different openings.

Alternatively, the barrel 105 is in one piece with the concentrator 104 and has a female connection to the hair dryer 10.

The diaphragm 6 located inside the barrel 5, 105, eliminates the vortices and enables the device to be used as a vacuum diffuser for cosmetic and perfuming products for hair.

The outgoing air passes through the two separate lobes defined by respective lateral passages 11, separated by the transverse septum 7, which is suitably rounded to produce two flows channeled into the slot of the concentrator with laminar motion.

The transverse septum 7 of diaphragm 6 has a cylindrical profile in the inlet part of the air flow to facilitate fluid dynamics, and adequate geometry and volume to contain the pad 15, which is cylindrical or of other suitable shape; holes or slots 13 enable part of the air flow to convey essences or cosmetic products towards the concentrator 4, 104, and therefore to the outlet.

Advantageously, in the air inlet part, i.e. the rear part 14, the cross section of the transverse septum 7 has an ogival profile or any other profile suitable for creating conditions for harmoniously separating the air flow, so as to avoid the formation of vortices according to Dean and Nekrassov conditions.

Advantageously, the device can be used without containing cosmetics to be dispersed, to eliminate the vortices, according to Dean and Nekrassov conditions.

One advantage of the present invention is that the device may be constructed as a separate piece or incorporated into a concentrator, or even be incorporated into the body of the hair dryer.

The device is manufactured using components of plastic or other materials including metals.

It has been established in practice that this invention accomplishes the intended aim and objects.

A device which has a connection for the front body of an electric hair dryer, at the air outlet, and a male connection for a concentrating nozzle (concentrator), to make the passage of the air passing through the device itself more uniform in pressure and temperature, and at the same time allowing the diffusion of cosmetic products for hair treatment, has in fact been provided.

Of course, the materials used, as well as the dimensions, may be adapted to meet any needs.

The invention claimed is:

1. A diffuser device for cosmetic liquids for hair dryers, comprising a cylindrical barrel (5, 105), which can be associated with a blowing part (3) of a hair dryer (10); said cylindrical barrel (5, 105) housing a diaphragm (6) comprising a transverse septum (7) which has a central expansion (8) and lateral lobes (9); said lateral lobes (9) having respective lateral passages (11); said central expansion (8) of said transverse septum (7) having a cavity (12) and being a front part provided with holes and slots (13); said central expansion (8) of said transverse septum (7) has' having a rear part (14) arranged opposite said front part and having a smooth non-perforated profile; said cavity (12) housing a pad (15) and being accessible via a hole (16) formed in said barrel (5, 105), and being adapted to be closed by a hermetic plug (17); said pad (15) being of textile material, which can be impregnated with cosmetic or perfuming liquids.

2. The device according to claim 1, characterized in that said hermetic plug (17) comprises a barbed stick (18) adapted to facilitate a removal of said pad (15) for replacement thereof.

3. The device according to claim 1, characterized in that said cylindrical barrel (5) has a female connection enabling said cylindrical barrel (5) to be attached to said blowing part (3) of said hair dryer (10); said cylindrical barrel (5) further comprising a male connection (19) to which an optional concentrator (4) may be connected.

4. The device according to claim 1, characterized in that said cylindrical barrel (105) is in one piece with a concentrator (104); said cylindrical barrel (105) having a female connection enabling said cylindrical barrel (105) to be attached to said blowing part (3) of said hair dryer (10).

5. The device according to claim 1, characterized in that said cylindrical barrel (5) is in one piece with said blowing part (3) of said hair dryer (10).

6. A hair dryer, characterized in that it comprises a diffuser device for cosmetic liquids according to claim 1.

* * * * *